US006148652A

United States Patent [19]

Magini et al.

[11] Patent Number: 6,148,652

[45] Date of Patent: Nov. 21, 2000

[54] PICKING TOOL FOR A DISC TUMBLER LOCK

[76] Inventors: Mark A. Magini; Michael K. Bradlee, both of 1021 E. Weldon, Phoenix, Ariz. 85014

[21] Appl. No.: 09/326,323

[22] Filed: Jun. 7, 1999

[51] Int. Cl.[7] ..... E05B 19/20

[52] U.S. Cl. ..... 70/394; 33/540

[58] Field of Search ..... 70/394, 395, 397–399, 70/400–401, 405–409; 33/539, 540

[56] References Cited

U.S. PATENT DOCUMENTS

| | | | |
|---|---|---|---|
| 1,991,151 | 2/1935 | Hansen | 70/394 |
| 2,059,376 | 11/1936 | Lombardo | 70/394 |
| 2,070,342 | 2/1937 | Tarrie | 70/394 |
| 2,087,423 | 7/1937 | Abrams | 70/394 X |
| 2,279,592 | 4/1942 | Machinist | 70/394 |
| 2,338,768 | 1/1944 | Johnstone | 70/394 |
| 2,720,032 | 10/1955 | Harwell | 70/394 |
| 2,791,840 | 5/1957 | Harwell | 70/394 |
| 3,735,496 | 5/1973 | Lee | 33/540 |
| 3,827,151 | 8/1974 | Naill | 70/394 X |
| 3,987,654 | 10/1976 | Iaccino et al. | 70/394 X |
| 4,185,482 | 1/1980 | Nail | 70/394 |
| 4,667,494 | 5/1987 | Joosten | 70/394 |
| 5,956,984 | 9/1999 | Hughes | 70/394 |

FOREIGN PATENT DOCUMENTS

| | | | |
|---|---|---|---|
| 2340434 | 9/1977 | France | 70/394 |
| 2388965 | 12/1978 | France | 70/394 |
| 2389739 | 1/1979 | France | 70/394 |
| 2392202 | 1/1979 | France | 70/394 |
| 051297 | 4/1977 | Japan | 70/394 |

*Primary Examiner*—Suzanne Dino Barrett
*Attorney, Agent, or Firm*—Warren F. B. Lindsley; Frank J. McGue

[57] ABSTRACT

A lock picking tool for a high security four-track disc tumbler lock, the tool probing all four tracks simultaneously.

13 Claims, 3 Drawing Sheets

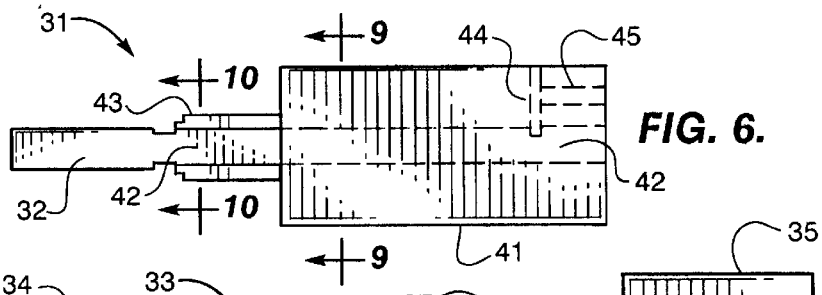
FIG. 6.
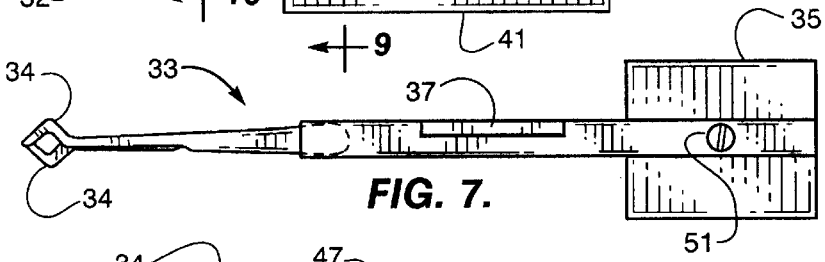
FIG. 7.
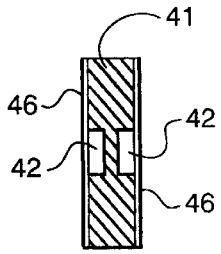
FIG. 9.
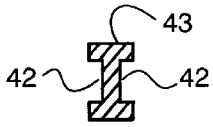
FIG. 10.
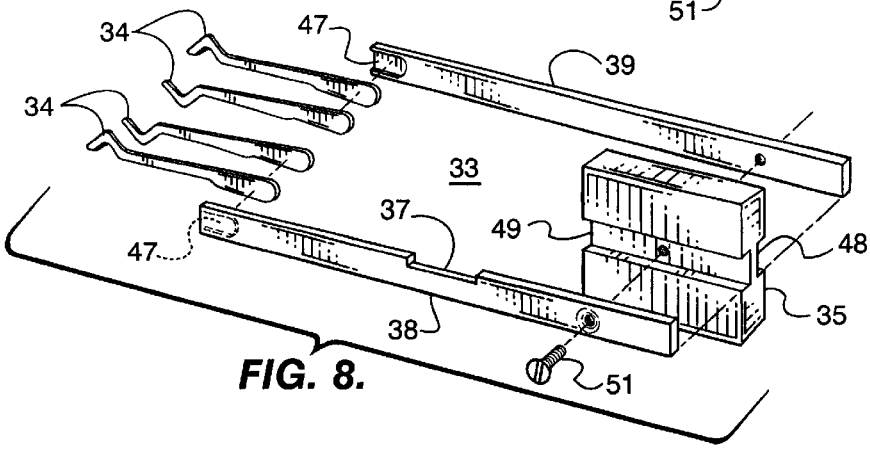
FIG. 8.
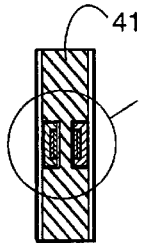
FIG. 11B.
FIG. 11A.
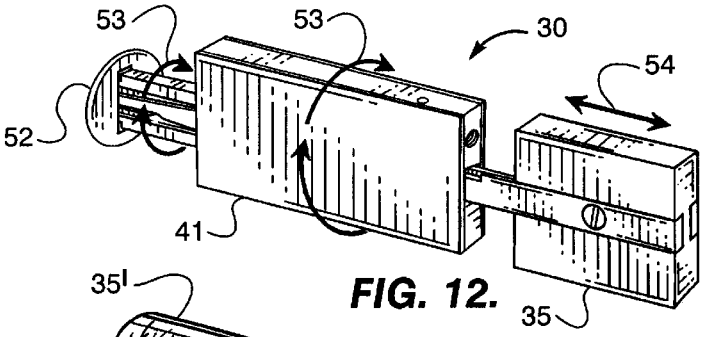
FIG. 12.
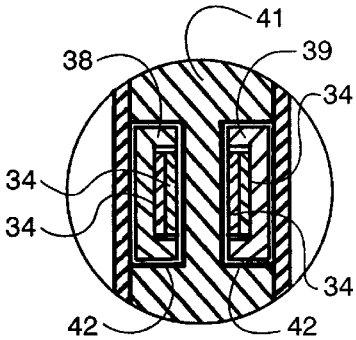
FIG. 11B.
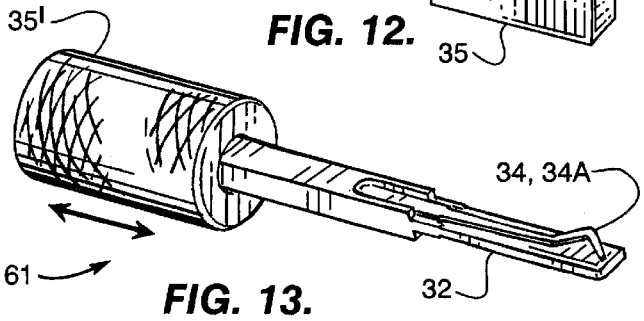
FIG. 13.
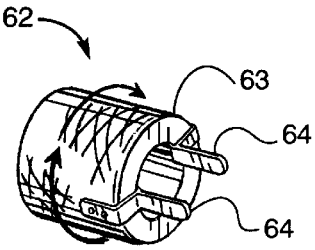
FIG. 14.

PICKING TOOL FOR A DISC TUMBLER LOCK

BACKGROUND OF THE INVENTION

This invention concerns a tool for use by a licensed locksmith in the picking of a high-security lock of an automobile in the event the key has been lost or misplaced or when the doors have been locked with the key still in the ignition. In the past, such locks were rather easily picked by an experienced locksmith using simple probe-type tools to unlock one tumbler at a time. More recently, however, automobile locks have become more difficult to pick as manufacturer's have sought to provide a higher degree of security for their automobiles.

A particularly difficult lock to pick is the european four-track disc tumbler lock which has, to date, resisted the efforts of the most highly-skilled locksmiths. The present invention provides a tool that renders this challenge doable by a person of relatively modest lock-picking skills.

DESCRIPTION OF THE PRIOR ART

The simple picking tools of the prior art have proven ineffective for the sophisticated locks of the type employed in late model european automobiles, and no improved devices for picking such locks are known to exist at the present time.

SUMMARY OF THE INVENTION

In accordance with the invention claimed, a novel lock-picking tool is provided for use in picking highly-secure disc tumbler locks of the type employed in late model european automobiles.

It is, therefore, one object of this invention to provide a lock picking tool for use in picking four-track disc tumbler locks.

Another object of this invention is to provide such a lock picking tool specifically for use in picking the BMW lock.

A further object of this invention is to provide such a tool in a form which enables a locksmith with average skills and experience to pick such locks in a reasonably short period of time such as a few minutes.

Yet another object of this invention is to provide such a tool in a reasonably simple and inexpensive form.

Further objects and advantages of the invention will become apparent as the following description proceeds and the features of novelty which characterize the invention will be pointed out with particularity in the claims annexed to an forming a part of this specification.

BRIEF DESCRIPTION OF THE DRAWINGS

The present invention may be more readily described by reference to the accompanying drawings in which:

FIG. 6 is a side view of the main body of the lock picking tool of FIGS. 3 and 4;

FIG. 7 is a side view of the movable feeler probe of the tool of FIGS. 3, 4 and 5;

FIG. 8 is an exploded perspective view of the feeler probe of FIG. 7;

FIG. 9 is a cross-sectional view taken along line 9—9 of FIG. 6;

FIG. 10 is a cross-sectional view taken along line 10—10 of FIG. 6;

FIG. 11A is a cross-sectional view taken along line 11A—11A of FIG. 4;

FIG. 11B is an enlarged view of the portion of FIG. 11A enclosed by the circle 11B shown in FIG. 11A;

FIG. 12 is a simplified perspective view showing the lock-picking tool in use during the picking of a lock;

FIG. 13 is a plan view of a second less expensive embodiment of the invention;

FIG. 14 is a side view of a torque tool that is employed in conjunction with the lock picking tool of FIG. 13;

DESCRIPTION OF THE PREFERRED EMBODIMENT

Figure 1:
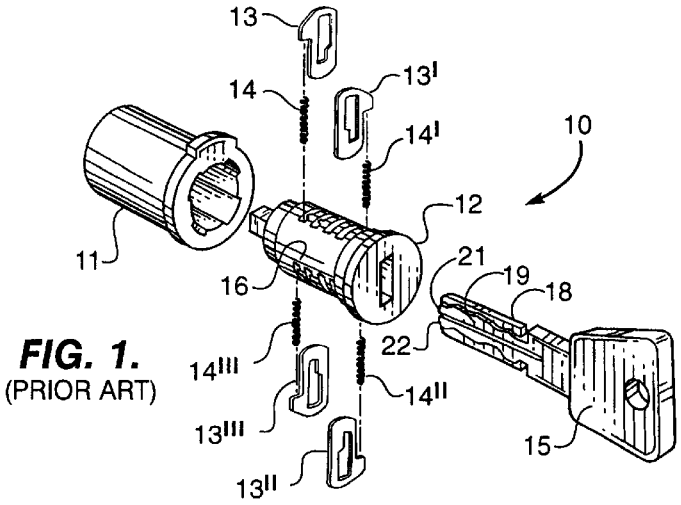
FIG. 1. (PRIOR ART)
FIG. 1 is a simplified perspective view of a partially disassembled four-track disc tumbler lock and key of the type for which the lock picking tool of the invention is intended.

Referring more particularly to the drawings by characters of reference, FIG. 1 illustrates the type of lock for which the picking tool of the present invention is intended. Lock 10 of FIG. 1 is a four-track disc tumbler lock of the type employed in certain late model automobiles such as the BMW and comprises a shell or body 11, a plug 12, tumblers or wafers 13, 13', 13" and 13'" and springs 14, 14', 14" and 14'". Lock 10 is normally operated by a mating key 15. For purposes of illustration, the wafers and springs are shown as withdrawn from the plug with the plug withdrawn from the shell.

When lock 10 is completely assembled with the wafers installed in the radially directed slots 16, with the springs installed in tubes adjacent slots 16, and with plug 12 installed in shell 11, the springs drive the wafers outwardly past the shear line of the lock into locking positions between longitudinal ridges 17 located along the interior of shell 11. As indicated in FIG. 1, some of the wafers 13, 13' are driven upwardly into locking positions and others 13", 13'" are driven downwardly into locking position.

Key 15 has a central rectangular blade 18 with a raised key pattern 19 on each side (the far side being hidden in the drawing). Each raised key pattern has an upper and a lower trace, 21 and 22, respectively, for a total of four key traces. With key 15 inserted in lock 10, the upper key traces 21 drive the wafers which are driven downwardly by the springs and the lower traces 22 drive the wafers which are driven upwardly by the springs. In both cases, the traces move the wafers in directions opposite the spring forces into positions inward of the shear line causing the lock to be released. The near side and the opposite or far side key traces control oppositely facing wafers of both the upper and lower extending wafer groups.

The four wafer groups are further illustrated by FIGS. 2A, 2B, 2C and 2D. Note that corresponding wafers and springs are shown in FIG. 1 as indicated by common reference numerals.

Figure 2A:
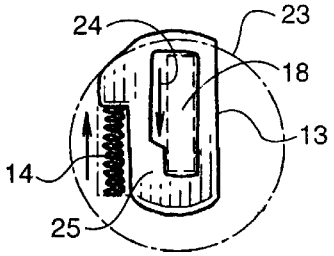
FIG. 2A. (PRIOR ART)
FIG. 2A–2D are enlarged representations of the wafer and spring assemblies of the lock of FIG. 1 showing the locked positions of four different disc tumblers relative to the shear line for the lock of FIG. 1.

In FIG. 2A, spring 14 drives wafer 13 upwardly past the shear line 23 into its locking position, and the near-side lower trace of key 15 drives the wafer downwardly as indicated by arrow 24 acting upon shoulder 25. The height of shoulder 25 must be coordinated with the dimension of the key trace at the particular wafer location. If the shoulder is too low, the upper end of the wafer will not be completely withdrawn from above the shear line; if the shoulder is too high, the lower end of the wafer will extend below the shear line and the lock will not be replaced.

Figure 2B:
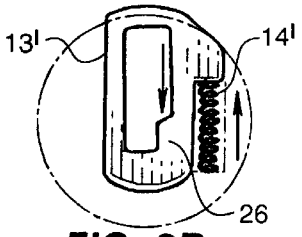
FIG. 2B. (PRIOR ART)

In FIG. 2B, the spring 13' again drives the wafer upwardly past the shear line. The wafer faces in a direction opposite that of wafer 13 of FIG. 2A, and is driven downwardly in this case by the far-side lower trace of the key 15. Note that in FIG. 2B, a shoulder 26 of a different height is indicated.

Figure 2C:
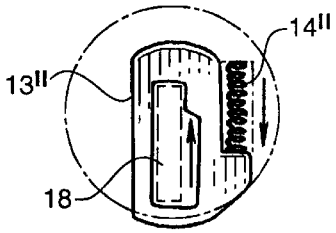
FIG. 2C. (PRIOR ART)

In FIG. 2C, the spring 14" drives wafer 13" downwardly into a locking position with the lower end of the wafer extending below the shear line. The wafer is driven upwardly in opposition to the spring force by the far-side upper key trace.

Figure 2D:
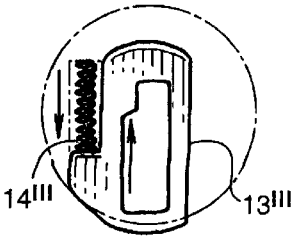
FIG. 2D. (PRIOR ART)

In FIG. 2D, the spring force is again downward and the oppositely directed wafer 14" (relative to the wafer 14" of FIG. 2C) is driven upwardly by the near-side upper key trace 21.

Lock 10 is thus seen to comprise four groups of wafers controlled by four corresponding key traces and may be characterized as a four-track lock. By virtue of the four separately controlled tracks, the lock is rendered virtually impossible to be picked with ordinary lock picking tools, even by a highly capable and experienced locksmith.

Figure 3:
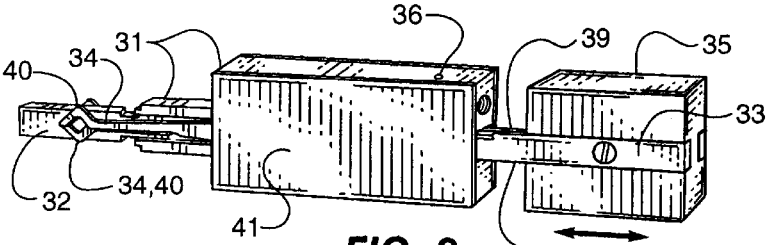
FIG. 3 is a perspective view of the lock-picking tool of the invention.
Figure 4:
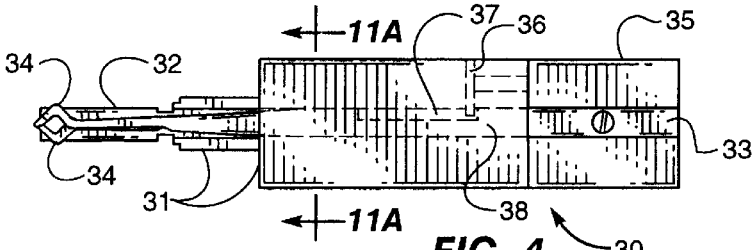
FIG. 4 is a side view of the lock picking tool of the invention showing the feelers or probes in their fully extended position.

The lock picking tool 30 of the invention, as shown in FIGS. 3 and 4, comprises a stationary member 31 having a main body 41 and an integral longitudinally extending blade 32 at its forward end, and a movable probe 33 that slidably passes through the stationary member 31 driving two pairs of feelers 34 with one pair being movable along each side of blade 32.

The blade 32 at its forward end has a cross-section matching that of the central rectangular blade 18 of key 15 of FIG. 1 and in the use of the picking tool 30 the blade is inserted into the key slot of lock 10. When blade 32 is inserted into the key slot it substantially fills the wafer openings except for the space above or below shoulder 26 (See FIGS. 2A and 2C). Feelers 34 which move along the surfaces of blade 32 are thus constrained to pass through the open spaces above or below shoulder 26 as they are driven back and forth by means of a hand grip 35 located at the rearward end of probe 33.

Figure 5:
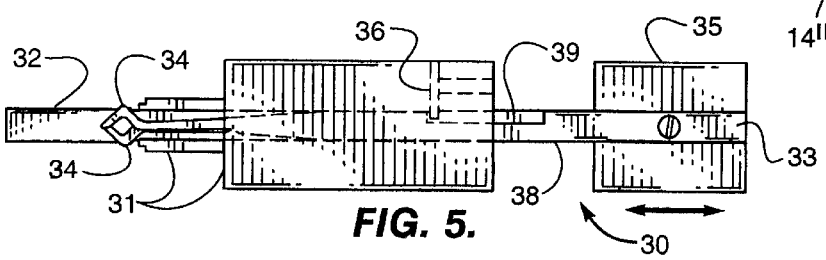
FIG. 5 is a side view of the lock picking tool of the invention showing the feelers or probes in the withdrawn position.

FIG. 4 shows probe 33 with its feelers 34 fully extended. FIG. 5 shows the feelers fully withdrawn. The fully extended position is limited by means of a limit pin 36 that passes vertically downward from the top of the main body and extends into a longitudinal slot 37 in one of two slides 38, 39. This position may also be limited by hand grip 35 as it comes to bear against the rearward end of main body 31. The fully withdrawn position is limited by pin 36 and the forward end of slot 37.

Additional details of the construction of stationary members 31 and probe 33 are clarified in FIGS. 6–11.

The main body 41 of stationary member 31, as shown in FIGS. 6, 9 and 10, has a generally rectangular shape in the form of a thick metal plate with centered longitudinal slots 42 on opposite faces, the width and depths of the slots 42 being dimensioned to slidably receive the slides 38 and 39 of probe 33. The slots 42 continue as shown in FIGS. 6 and 10 into a blade support extension 43 that protrudes longitudinally from the forward end of main body 41. Blade 18 extends from the forward end of extension 43. A bore 44 for the slide limit pin 36 enters one of the slots 42 perpendicularly from one edge of hand grip 41. The bore 44 may be threaded for a threaded limit pin or a second bore 45 may be provided, intersecting bore 44 perpendicularly with the second bore threaded for a retainer screw. Metal cover plates 46 are cemented or otherwise secured to both faces of hand grip 41, covering slots 42.

The probe 33 comprises hand grip 35, slides 38 and 39 and four feelers 34.

The slides 38 and 39 are metal strips approximately four inches long, one-eighth inch thick and one quarter inch wide. Slide 38 is slotted along one edge to receive the limit pin. Each slide has a depression 47 machined or milled into one side of its forward end to receive the rearward end of a pair of feelers.

The feelers 34 are cut or stamped from a thin gauge spring steel. Feelers formed from piano wire have also been found to serve satisfactorily for some types of locks. The forward end of each feeler has a hook-shaped lateral projection 40 that ramps outwardly to a rounded peak, its shape resembling that of a prior art picking tool commonly known as a diamond pick. The feelers 34 have relatively long and slender bodies. This gives them the desired flexibility which will permit them to ride over a wafer that has already been moved to an unlocked position.

As shown in FIGS. 7 and 8, two oppositely directed feelers 34 are attached to each side, 38 and 39, their rearward ends welded, cemented or otherwise secured, one atop the other into depression 47. Prior to the attachment of the hand grip 35 to slides 38 and 39, slides 38 and 39 are inserted into slots 42 of main body 41 from the forward end of main body 41. The hand grip 35 is then positioned between slides 38 and 39, the slides are dropped into slots 48 and 49, one on each side of hand grip 35, and are retained therein by a screw 51 that passes through aligned holes in slide 38, hand grip 35 and turns into an aligned threaded hole in slide 39. The limit pin is then installed in main body 41 of stationary member 31 to complete the assembly.

FIGS. 9, 10 and 11 further clarify relationships and orientations of the various components of the picking tool 30.

FIG. 9 shows a cross section of main body 41 of stationary member 31 prior to the installation of the movable probe 33. The slots 42 which slidably receive slides 38 and 39 are seen to be enclosed by cover plates 46.

FIG. 10 shows the cross section of blade support extension 43 in which the slots 42 of main body 41 continue in the same dimensions.

FIGS. 11A and 11B taken at line 11A—11A of FIG. 4 show a cross section of a final assembly of tool 30, illustrating the relative positions of slides 38 and 39 and four feelers 34 inside slots 42 of main body 41.

In the use of tool 30 as shown in FIG. 12, the blade 32 of the tool are inserted into keyhole 52 of the particular four-track disc tumbler lock for which the tool is designed. With one hand the locksmith applies a slight rotational torque to main body 41 of stationary member 31 in the direction indicated by arrows 53. With the other hand, the locksmith grasps handgrip 35 of movable probe 33 and moves the feelers back and forth between the fully extended and fully withdrawn positions as indicated by arrows 54. As this action proceeds, the projecting tips of the feelers rake the shoulders of wafers 13, 13', 13", 13'", urging them toward their unlocked positions. With experience, the locksmith clears the optimum rotation torque required for opening the lock. With this optimal torque, the wafers tend to be driven from their locked positions to positions in which the opposite faces of the wafers are driven to the shear line on the opposite side of the lock where they tend to hand up. The torque applied to main body 41 causes the unlocked tumblers or wafers of the lock to be retained in their unlocked positions. This unlocking action proceeds simultaneously for all four tracks of the disc tumbler lock. With this tool and a minimal amount of experience, a locksmith can open such a lock in a matter of a few minutes.

A less expensive version of the lock picking tool of the invention with a reduced level of performance is shown in FIG. 13.

The picking tools of FIGS. 13 and 14 comprises a probe 61 and a torque tool 62.

The probe 61 comprises a blade 32 and a pair of feelers 34, 34A with one feeler secured at its rearward end each side of blade 32 and with both feelers facing in the same direction. Blade 32 and feelers 34, 34A are substantially identical to the like parts of tool 30 as described earlier, the blade and feeler assembly extending from a common hand grip 35' which may be rectangular or cylindrical. In this case, however, the feelers and the blade are secured together and the blade moves with the feelers.

Torque tool 62 has a hand grip 63 with a pair of prongs 64 extending from one end. The prongs are appropriately dimensioned and spaced to be inserted into the key hole of the lock as a means for applying torque to the lock while the probe is raked back and forth with the feelers acting upon the wafers of the lock. Because the probe 61 has only two feelers, both projecting in the same direction, probe 61 needs to be exercised first with the feelers projecting either upward or downward. The probe is then withdrawn, rotated 180 degrees and then exercised in this direction. Successive procedures in both directions may be required to open the lock. For the occasional user of the tool, the additional time and difficulty involved may prove acceptable at a significantly lower cost.

The principles of the invention are also applicable to lock picking tools for various other types of high security locks as illustrated in FIGS. 15–18 and 15A–18A.

Figure 15:
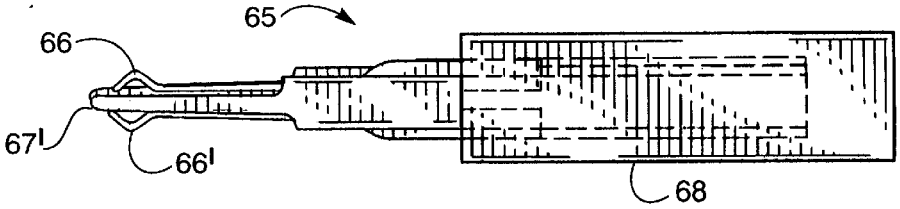
FIG. 15 is a plan view of a different embodiment of the invention.
Figure 15A:
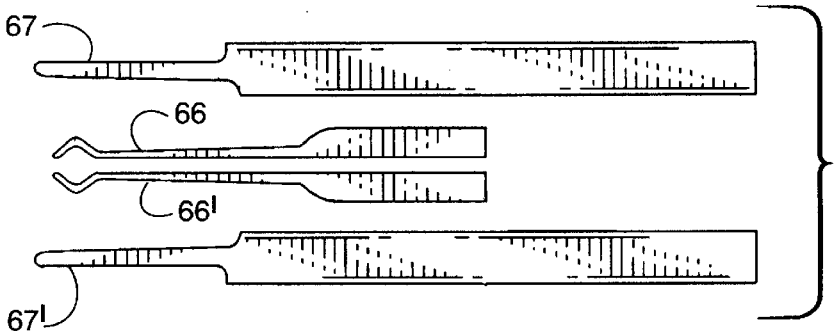
FIG. 15A is an exploded view of FIG. 15.

FIGS. 15 and 15A show a lock picking tool or probe 65 for a Japanese split disc lock with a center keyway. The tool 65 has a pair of oppositely extending back-to-back feelers 66, 66' sandwiched between two feeler guides 67, 67', the feelers 66, 66' and the guides 67, 67' extending from a hand grip 68.

Figure 16:
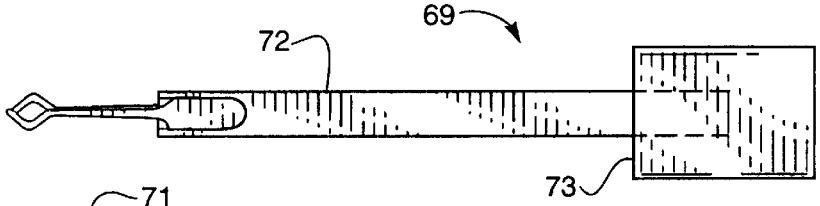
FIG. 16 is a plan view of a further embodiment of the invention.
Figure 16A:
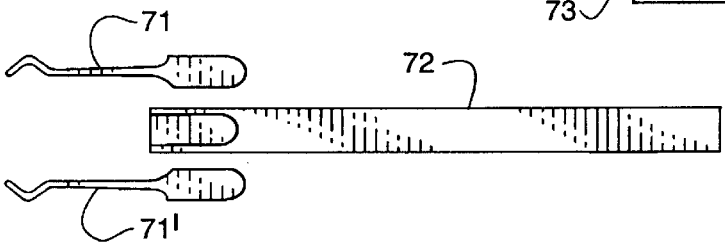
FIG. 16A is an exploded view of FIG. 16.

FIGS. 16 and 16A show a lock picking tool or probe 69 for opening Japanese single and double sides disc locks of a type used for automobile doors and trunks. The tool 69 comprises a pair of oppositely extending feelers 71, 71' mounted side-by-side. The two feelers are secured to opposite dies of a mounting blade 72 which spaces the feelers apart as needed to accommodate the lock geometry. A hand grip 73 is secured to the end of blade 72 opposite the end to which the feelers are attached.

Figure 17:
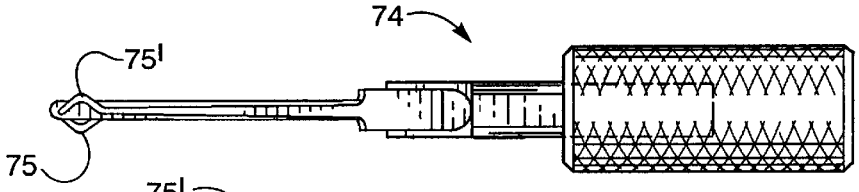
FIG. 17 is a plan view of yet another embodiment of the invention.
Figure 17A:
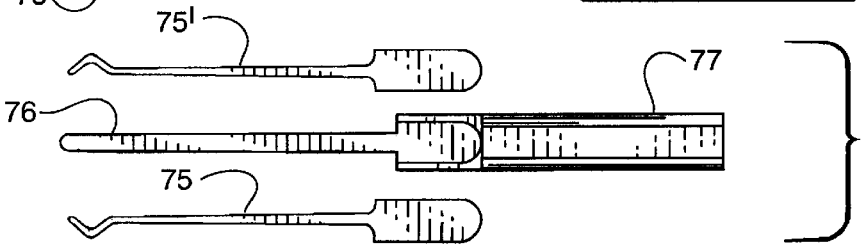
FIG. 17A is an exploded view of FIG. 17.

FIGS. 17 and 17A show a lock picking tool or probe 74 for another type of Japanese single or double sided disc lock employed as an automobile ignition lock. The tool 74 comprises a pair of side-by-side oppositely extending feelers 75, 75' with a spacer blade 76 sandwiched between the two feelers. The two feelers are secured to opposite faces of the blade 76 at one end of the blade. A hand grip 77 is secured to the other end of the blade.

In the use of the lock picking tools 65, 69 and 74 of FIGS. 15, 16 and 17, respectively, the feelers are moved back and forth while torque is applied by means of a torque tool similar to the torque tool 62 as described in connection with lock picking tool 61 of FIG. 13.

Figure 18:
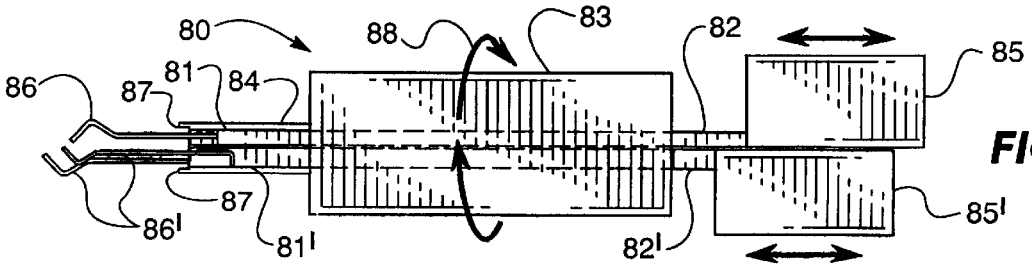
FIG. 18 is a plan view of a still further embodiment of the invention.

Yet another lock picking tool incorporating the principles of the present invention is shown in FIG. 18. Lock picking tool 80 of FIG. 18 is a variation of tool 30 of FIG. 3, but while tool 30 employed a single movable probe that probed four tracks of a lock with each sweep of the feelers, tool 80 has two movable probes that are exercised, on at a time.

As shown in FIG. 18, tool 80 comprises two individually movable probes 81, 81', each of which has a slide bar 82, 82' that passes through the main body 83 and through an extension 84 of main body 83. Individual hand grips 85, 85' are provided, and each probe carries its own set of feelers 86, 86'. Note that in the example shown, probe 81' employs two feelers 86' that are spaced apart longitudinally with the feelers 86' extending oppositely to feelers 86. This is to accommodate a particular lock type, but other feeler configurations are anticipated for different lock configurations.

In the use of tool 80, a pair of prongs 87 extending forwardly from extension 84 are inserted in the ends of a lock. Then, as a rotational force 88 is applied to main body 83 the probes 81 and 81' are moved back and forth, one at a time, repetitiously until the lock is opened.

A new and improved lock pick is thus provided in accordance with the objects of the invention and although but a few embodiments of the invention have been illustrated and described, it will be apparent to those skilled in the art that various changes and modifications may be made therein without departing from the spirit of the invention or from the scope of the appended claims.

What is claimed is:

1. A picking tool for a disc tumbler lock, said tool comprising:

a stationary body member having an integral blade extending longitudinally thereof;

a movable probe assembly slidably coupled to said stationary body member;

said movable probe assembly comprising a plurality of feelers at one end thereof and an associated hand grip at the other end;

one of said feelers being caused to move longitudinally along one side of said blade and another of said feelers being caused to move longitudinally and correspondingly to the movement of said one of said feelers along the other side of said blade as said probe assembly is moved by means of said hand grip;

whereby when said blade is inserted into a keyway of said tumbler lock and said probe assembly is moved back and forth along said stationary body member by means of said hand grip when an appropriate level of torque is applied to said lock by means of said stationary member, said first member of said feelers are caused to probe the tumblers of all tracks of said disc tumbler lock during each pass of said probe along the length of said blade so that after a few passes of said feelers back and forth along said blade said lock is released.

2. A picking tool for a disc tumbler lock, said tool comprising:

a stationary body member having an integral blade extending longitudinally thereof;

a movable probe assembly slidably coupled to said stationary body member;

said movable probe assembly comprising a plurality of feelers at one end thereof and a hand grip at the other end;

a first pair of said feelers being movable longitudinally along one side of said integral blade and a second pair of said feelers being movable longitudinally and correspondingly to the movement of said first pair of said feelers along the other side of said blade as said probe assembly is moved longitudinally back and forth of said blade by means of said hand grip;

whereby when said blade is inserted into a keyway of said tumbler lock and when said movable probe assembly is moved back and forth along said blade by said hand grip with an appropriate level of torque applied to said lock by means of said stationary member;

said feelers are caused to probe the tumblers of all tracks of said disc tumbler lock during each pass of said probe along the length of said blade so that after a few passes of said feelers back and forth along said integral blade said lock is released.

3. The lock picking tool set forth in claim 2 in further combination with means for limiting the travel of said feelers along said blade.

4. The lock picking tool set forth in claim 2 wherein said first pair of feelers project laterally in opposite directions to said second pair of feelers.

5. A picking tool for a high security four-track disc tumbler lock, said tool comprising:

a stationary member having an integral blade extending longitudinally thereof, the stationary member further having a rectangular body extending longitudinally of said blade with two parallel slots passing longitudinally through said body;

a movable probe assembly slidably coupled to said stationary member via said parallel slots, said movable probe assembly comprising two slides, four feelers and a hand grip;

each of said two slides comprising a narrow metal strip dimensioned to fit slidably into one of said parallel slots of said hand grip;

each of said four feelers comprising a slender strip of spring steel having a forward end shaped to form a laterally projecting peak;

each of said two slides together with two of said four feelers forming a subassembly in which the rearward ends of said two feelers are secured to the forward end of said slide, one of said two feelers lying atop the other of said two feelers with the projecting peaks of said two feelers extending in opposite directions;

the rearward ends of said two slides extending through said parallel slots of said main body after which they are connected to said movable probe hand grip;

whereby when said integral blade of said stationary member is inserted into a keyway of said four-track tumbler lock and when said movable probe assembly is moved back and forth by means of said hand grip while an appropriate level of torque is applied to said lock by means of said stationary member and the blade, said two pairs of feelers are caused to move back and forth together along opposite sides of said blade, urging wafers of all four tracks of said disc tumbler lock toward their respective unlocked positions such that after a number of such trips back and forth, said lock is released.

6. The lock picking tool set forth in claim 5 in further combination with means for limiting the travel of said feelers along said blade.

7. The lock picking tool set forth in claim 6 wherein said means for limiting the travel of said feelers comprises:

a slot along an edge of one of said slides of said movable probe assembly; and pin means extending through said main body of said stationary member into said slot;

whereby said movable probe assembly is constrained to move no farther in either direction than the length and location of said slot permits.

8. A simplified lock picking tool for a high security four-track disc tumbler lock, said lock picking tool comprising:

a movable probe assembly;

a torque tool;

said movable probe assembly comprising a hand grip with an integral blade extending therefrom and with two feelers attached to said blade, one of said two feelers being located on each side of said blade; and said torque tool comprising a hollow hand grip with an opening extending therethrough and with a pair of integral spaced apart prongs extending longitudinally therefrom;

whereby in the use of said simplified lock picking tool said prongs are inserted into the keyhole of said lock, said blade and said feelers of said movable probe assembly are inserted through the opening of said torque tool, between said prongs of said torque tool and into the keyway of said lock, said probe then being moved back and forth through said keyway of said lock while torque is applied to the plug of said lock by means of said torque tool, repeating several times using the original orientation of said probe in said keyway and alternately with said probe rotated 180 degrees, the process being continued until said lock is released.

9. Picking tool for a disc tumbler lock, said tool a probe assembly;

a torque tool;

said probe assembly comprising a hand grip with a forwardly extending blade and with a pair of feelers extending forwardly from the forward end of said blade;

the rearward ends of said pair of feelers being attached to opposite faces of said blade; and the lateral projections at the forward ends of said feelers projecting in opposite directions;

said torque tool comprising a hollow hand grip with an opening extending therethrough and with a pair of integral spaced apart prongs extending therefrom;

whereby when using said picking tool said prongs of said torque tool are inserted into the keyhole of said lock, said feelers of said probe assembly being insertable through the opening of said torque tool and into the keyway of said lock, said feelers then being moved back and forth through said keyway while torque is applied to the plug of said lock by means of said torque tool, the process being continued until said lock is released.

10. The picking tool set forth in claim 9 in further combination with a spacer blade that extends forwardly from the forward end of said mounting blade between the two feelers of said pair of feelers to a point just forward of the forward ends of said feelers;

whereby said spacer blade spaces said feelers apart as appropriate for unlocking single and double sided disc tumbler locks.

11. A lock picking tool for a disc tumbler lock comprising:

a probe assembly;

a torque tool;

said probe assembly comprising a hand grip, two feeler guides and a pair of back-to-back feelers sandwiched between said feeler guides;

said pair of back-to-back feelers and said feelers extending outwardly and longitudinally of from said hand grip;

the lateral projections at the forward ends of said feelers projecting in opposite directions;

said hand grip comprising a hollow configuration having an opening extending therethrough and a pair of integral spaced apart prongs extending therefrom;

whereby in use of said lock picking tool said prongs of said torque tool are inserted into the keyhole of said lock, said feelers of said probe assembly are inserted through the opening of said torque tool and into the keyway of said lock, said feelers being movable back and forth through said keyway while torque is applied to the plug of said lock by means of said torque tool, the process being continued until said lock is released.

12. A tool for picking through a keyhole of a high security disc tumbler lock, said tool comprising:

a main body with a forward extension;

first and second movable probes passing slidably side-by-side through said main body;

each of said movable probes comprising a slide bar having a rearward end and a forward end, the slide bar having a hand grip at the rearward end and with at least one feeler at the forward end;

said forward extension of said main body having a pair of forwardly extending prongs spaced apart for inserting into the ends of the keyhole for applying torque to the plug of said lock;

whereby when using said tool to pick a lock, said prongs of said forward extension of said main body are inserted into the keyhole of said lock and torque is applied to the plug of said lock by grasping said main body of said tool while moving said hand grips back and forth and moving at least one of said probes causing said feelers to sweep back and forth through said lock and repeating the process until the lock opens.

13. The lock picking tool set forth in claim 12 wherein:

said first movable probe has a single feeler;

said second movable probe has two feelers spaced apart from the other; and the forward ends of the feelers of said second movable probe project laterally in the direction opposite the direction in which the feeler of said first movable probe projects.

* * * * *